US005761564A

United States Patent [19]

Piccinino, Jr.

[11] Patent Number: 5,761,564

[45] Date of Patent: Jun. 2, 1998

[54] PHOTOGRAPHIC PROCESSING APPARATUS

[75] Inventor: Ralph L. Piccinino, Jr., Rush, N.Y.

[73] Assignee: Eastman Kodak Company, Rochester, N.Y.

[21] Appl. No.: 799,162

[22] Filed: Feb. 14, 1997

[51] Int. Cl.[6] ..... G03D 3/02

[52] U.S. Cl. ..... 396/627; 396/636

[58] Field of Search ..... 396/626, 630, 396/627, 631, 636; 134/64 P, 64 R, 122 P, 122 R; 430/30, 398–400

[56] References Cited

U.S. PATENT DOCUMENTS

| | | | |
|---|---|---|---|
| 2,770,179 | 11/1956 | Dye et al. | 396/620 |
| 2,861,508 | 11/1958 | Baumbach et al. | 396/627 |
| 3,392,707 | 7/1968 | Marx | 396/627 |
| 4,044,964 | 8/1977 | Kellett | 242/598.1 |
| 4,775,873 | 10/1988 | Blackman et al. | 396/626 |
| 5,361,114 | 11/1994 | Earle | 396/625 |
| 5,387,499 | 2/1995 | Earle et al. | 396/620 |
| 5,452,043 | 9/1995 | Patton et al. | 396/627 |
| 5,508,776 | 4/1996 | Rosenburgh et al. | 396/636 |

*Primary Examiner*—D. Rutledge

*Attorney, Agent, or Firm*—Frank Pincelli; David A. Novais

[57] ABSTRACT

A photographic processor for processing a photosensitive material. The processor comprises at least one processing channel for containing a processing solution through which the photosensitive material passes for processing. The channel has a substantially constant thickness T. At least one slot nozzle is provided for directing processing solution against the photosensitive material passing through the processing channel. The channel is shaped such the nozzle is disposed a distance less than T from the opposing side wall of the channel such that the processing solution impinges against the photosensitive material.

15 Claims, 6 Drawing Sheets

PHOTOGRAPHIC PROCESSING APPARATUS

FIELD OF THE INVENTION

The present invention relates to improvements in or relating to photographic processing apparatus and, more particularly, with regard to photographic processors having narrowing processing channels and which use belts for transporting of the photosensitive material therethrough.

BACKGROUND OF THE INVENTION

In typical large photographic processing machines for processing photosensitive material, for example, paper, there is provided a plurality of tanks, each containing a photographic processing solution and a rack disposed therein for transporting of the photosensitive material therethrough. Typically, one or more continuous leader belts are provided for transporting of the photosensitive material to be processed through each of the processing tanks. These leader belts are located to one side of the processing path so as to not interfere with the movement of the photosensitive material along the processing path. The leading end of the photosensitive material is attached to a leader belt by means of a clip, which is typically made of metal. The photosensitive material to be processed is threaded through a slot provided in the clip. The clip has a mounting section which can be easily mounted to the moving belt and then later easily detached after passing the material through the processor.

U.S. Pat. Nos. 5,311,235; 5,309,191; 5,339,131; and 5,387,499 disclose processing apparatuses wherein a thin, narrow processing channel is provided for processing the photosensitive material and a low amount of processing solution is used. It has been found that low volume thin tank type processors provide certain distinct advantages. It has been found desirable that the processing solution be impinged against the photosensitive material as it passes through the processing channel. However, when a belt is used for transporting of a photosensitive material through the narrow processing channel, some adjustments must be made so as to accommodate the belt and clip used to secure the photosensitive material to the belt. As a consequence the width of the processing channel must be increased a small amount. While this increase in size is small it results in a very significant drop in the impingement force of the processing solution against the photosensitive material and thereby substantially affects the development of the processing material in the processing solution.

Therefore, there exists a need to provide a low volume thin tank processor, which utilizes a belt for transporting of the photosensitive material therethrough which minimizes or avoids the problems of the prior art.

SUMMARY OF THE INVENTION

In accordance with one aspect of the present invention there is provided a photographic processor for processing a photosensitive material. The processor, comprises:

at least one processing channel for containing a processing solution through which the photosensitive material passes for processing, the channel having a substantially constant thickness T, at least one slot nozzle is provided for directing processing solution against the photosensitive material passing through the processing channel, the channel being shaped such that the nozzle is disposed a distance less than T from the opposing side wall of the channel such that the processing solution impinges against the photosensitive material.

In accordance with another aspect of the present invention there is provided a photographic processor for processing a photosensitive material, the processor having at least one processing section. The processing section comprising a tank which forms a generally U-shaped chamber and a rack for placement in the chamber and forming a narrow processing channel between the rack and the tank for containing a processing solution. At least one nozzle is provided in the rack for directing processing solution against the photographic material passing through the processing channel. The rack and chamber are shaped such that the channel adjacent the at least one nozzle is not greater than about 5.5 mm.

In accordance with yet another aspect of the present invention there is provided a photographic processor for processing a photosensitive material. The processor comprises at least one processing section having a tank which forms a generally U-shaped chamber and a rack for placement in the chamber. The rack and tank form a narrow processing channel having a thickness T for containing a processing solution. At least one nozzle is provided for directing processing solution against the photographic material passing through the processing channel. The nozzle is positioned such that it is disposed from the opposing wall of the channel a distance TZ no greater than 5.5 mm.

In accordance with yet another aspect of the present invention there is provided a photographic processor for processing a photosensitive material, the processor having a processing section having a narrow thin processing channel of substantially constant thickness T for containing a processing solution through which the photosensitive material passes for processing. A belt is provided for transporting of the photosensitive material through the processing channel. The processing channel in the area through which the photosensitive material passes has a thickness TZ less than the substantially constant thickness T such that the processing solution impinges against the photosensitive material so as to provide the desired affect.

DETAILED DESCRIPTION OF THE DRAWINGS

Other objects, advantages and features of the present invention will become apparent from the following specification when taken in conjunction with the complete drawings in which like elements are commonly enumerated and in which.

DETAILED DESCRIPTION OF THE INVENTION

Figure 1:
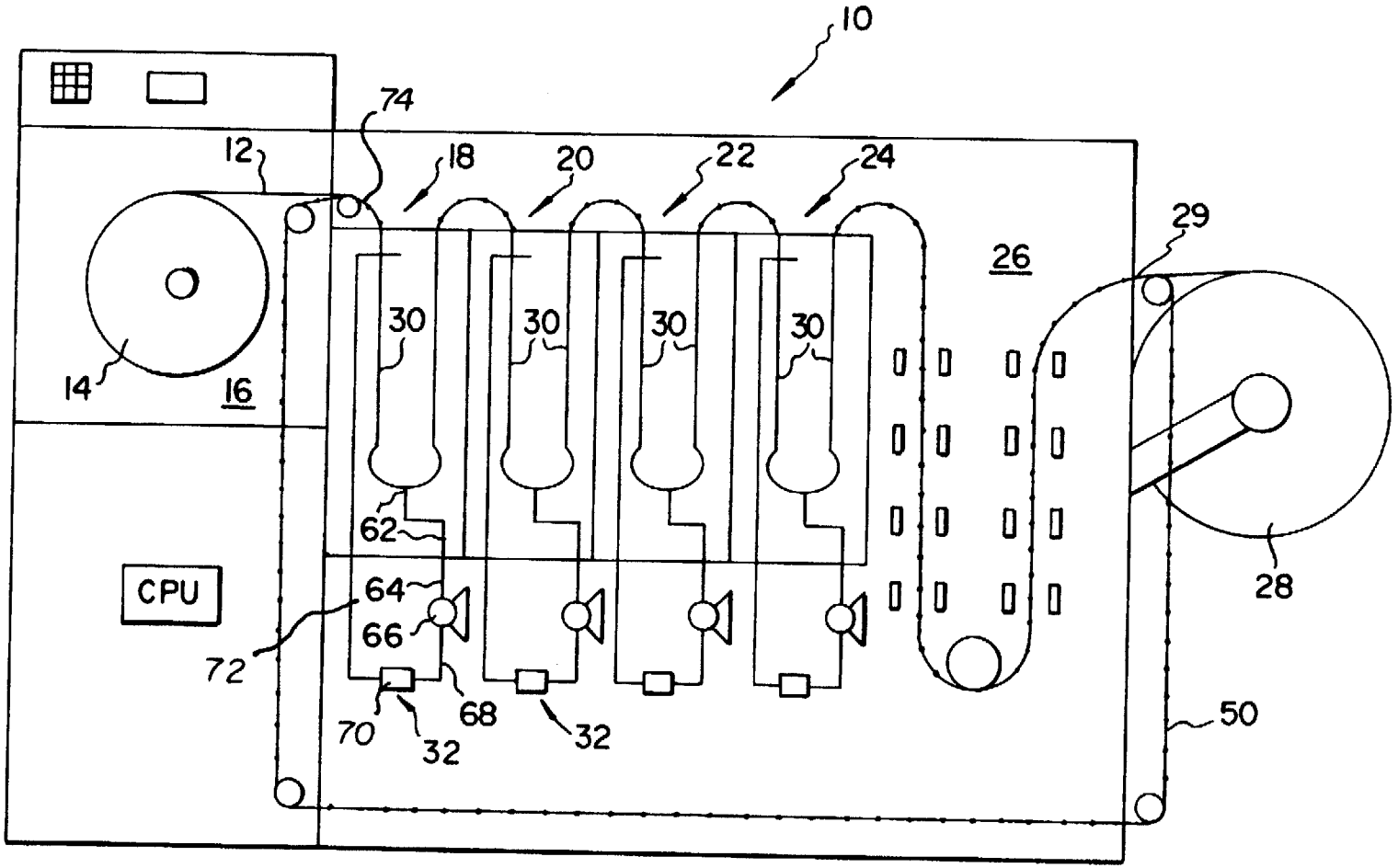
FIG. 1 is a schematic view illustrating a processing apparatus made in accordance with the present invention.

Referring to FIG. 1, there is illustrated a processing apparatus 10 made in accordance with the present invention for processing a photosensitive material 12. In the particular embodiment illustrated, the photosensitive material 12 is provided on a supply roll 14 that is placed in supply chamber 16. The photosensitive material 12 is fed from the supply roll 14 through a plurality of processing stations 18,20,22,24 wherein the photosensitive material is subjected to different photographic processing solutions. In the particular embodiment illustrated, the processing station 18 is designed for subjecting the photosensitive material 12 to a photographic developing solution; photoprocessing station 20 is designed to subject the photosensitive material to a photographic bleach/fix processing solution; and stations 22,24 are designed to subject the photosensitive material to rinse solutions. It is, of course, understood that any desired number of processing stations with appropriate processing solutions may be provided in accordance with the photosensitive material being processed. In the particular embodiment illustrated, the photosensitive material 12 is photographic paper, however, the present invention is not limited to such.

After leaving processing station 24, the photosensitive material is passed through dryer section 26 where it is dried and then passed on out of the apparatus 10 through exit 29 onto a take-up roll 28.

Each of the processing stations 18,20,22,24 are of the low volume thin tank type, that is, a narrow processing channel 30 is provided for containing of the processing solution through which the photosensitive material passes. Additionally, a minimal amount of processing solution is provided in each of the recirculation systems 32 associated with each of the stations.

Figure 2:
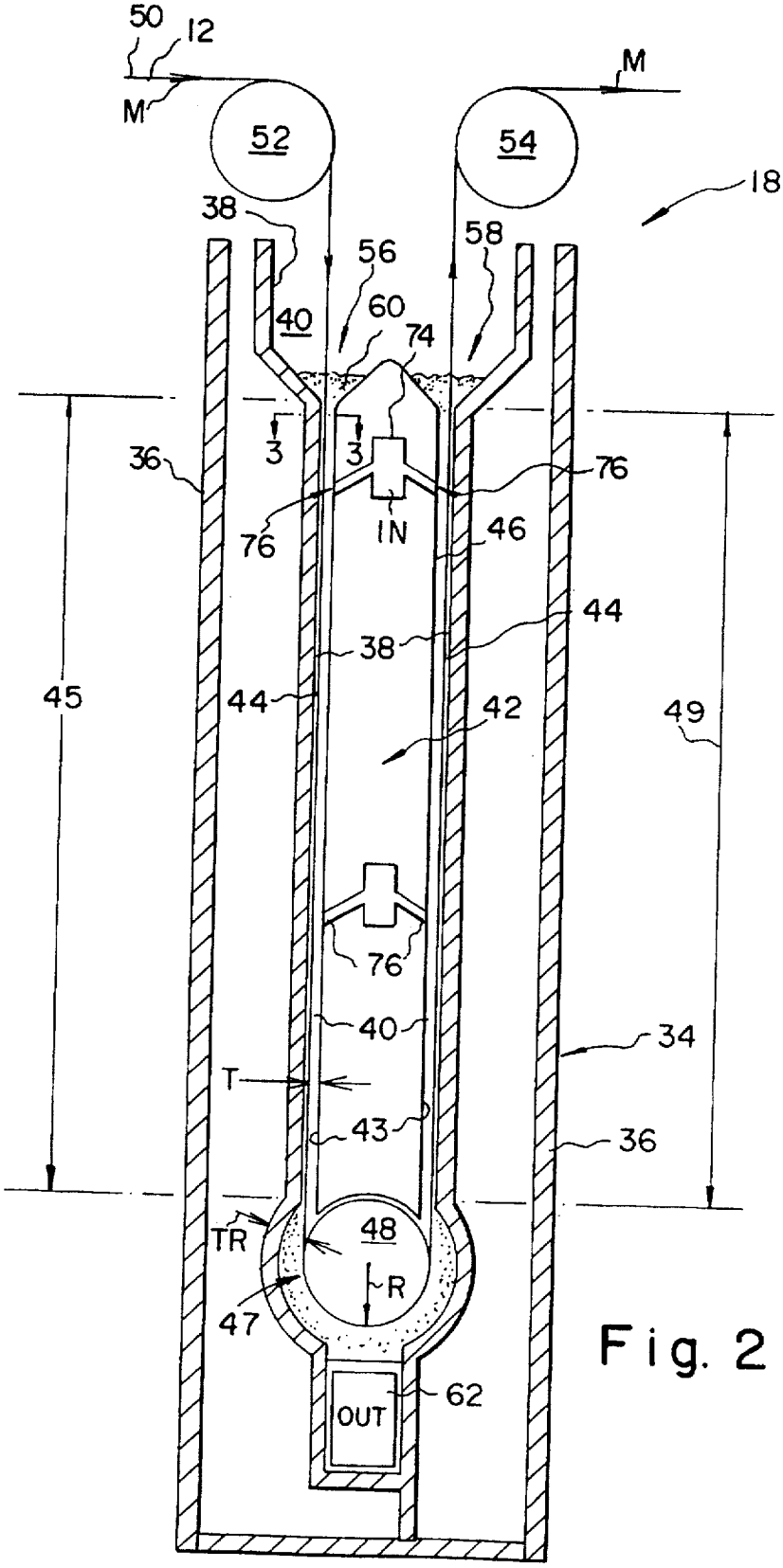
FIG. 2 is a schematic view illustrating one of the processing tanks illustrated in FIG. 1.

Referring to FIG. 2, there is illustrated in greater detail the rack and tank construction of processing station 18. It is to be understood that the other processing stations 20,22,24 are similarly constructed. The processing station 18 includes a processing tank 34 having an exterior wall 36 and a generally U-shaped inner wall 38 which forms chamber 40. Disposed within chamber 40 is a rack 42, which has an exterior wall 43 shaped such that a narrow processing channel 44 is formed between the exterior wall 43 of rack 42 and inner wall 38 of chamber 40. In the embodiment illustrated, channel 44 comprises a first straight section 45, a turn-around section 47, and a second straight section 49, the straight sections 45,49 of channel 44 having a substantially constant thickness T. Attached to the lower end of rack 42 there is provided a turn-around roller 48 which forms turn-around section 47. In the particular embodiment illustrated, a continuous belt 50 is provided for transporting of the photosensitive material 12 through the processor 10. A pair of guide rollers 52,54 are provided for guiding of the belt 50 into the entrance 56 of channel 44 and exit 58 of channel 44. A photographic processing solution 60 is placed in the processing channel 44 formed between the rack 42 and tank 34.

Referring to FIGS. 1 and 2, the processing solution is recirculated through the processing channel 44. In particular, processing solution is withdrawn from the processing channel 44 through outlet 62 and is directed through an appropriate conduit 64 to recirculation pump 66. The pump 66 circulates the processing solution through conduit 68, filter assembly 70, and then through conduit 72 to inlet 74 provided in rack 42. Each of the inlets 74 is in turn connected to a pair of slot nozzles 76, which extend across the rack (see FIG. 4) for allowing impingement of the processing solution against the photosensitive material 12 passing through straight sections 45,49 of processing channel 44.

In order to provide efficient flow of the processing solution through slot nozzles 76, it is desirable that the nozzles deliver the processing solution in accordance with the following relationship:

$$0.6<F/A<23$$

wherein:

F is the flow rate of solution through the nozzle in liters/minute; and

A is a cross-sectional area of the nozzle 76 provided in $cm^2$.

Providing a nozzle in accordance with the foregoing relationship assures a proper impingement discharge of the processing solution against the photosensitive material.

Figure 6:
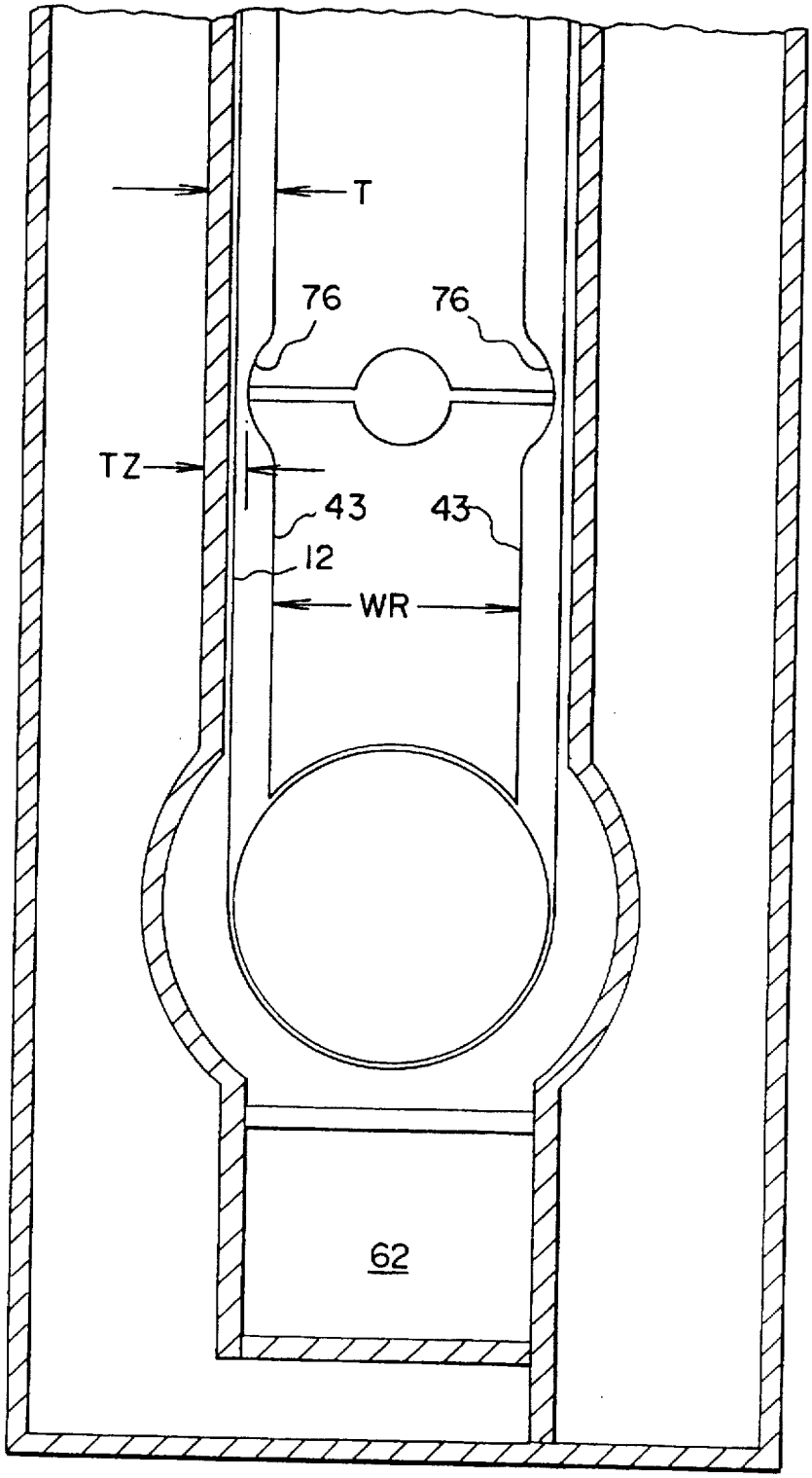
FIG. 6 is an enlarged cross-sectional view of the turnaround section of the tank of FIG. 2.

In order to accommodate the clip and belt used to transport the photosensitive material, the thickness T of the channel 44 (see FIG. 3) is increased over a processor that does not use a belt. However, it is important that the nozzles 76 be maintained as close as possible to the photosensitive material 12 while allowing appropriate clearance for the clip and belt to pass therethrough. The present invention solves this problem by placing the nozzles 76 closer to the photosensitive material 12. As illustrated in FIG. 6, the nozzles 76 are extended from the exterior wall 43 of rack 42 so that the distance TZ between the nozzle 76 and the inner wall 38 of chamber 40 is minimized. Thus, the distance TZ will be less than the thickness T of the processing channel 44. Preferably, the thickness TZ is only slightly greater than the thickness TP of the clip and photosensitive material passing by the adjacent nozzle 76. The thickness TZ is such that the impingement characteristics of the solution against the photosensitive material are not substantially affected. Applicants have found that the distance TZ is for the desired flow characteristics, preferably not greater 5.5 mm, most preferably no greater than about 3 mm.

Figure 7:
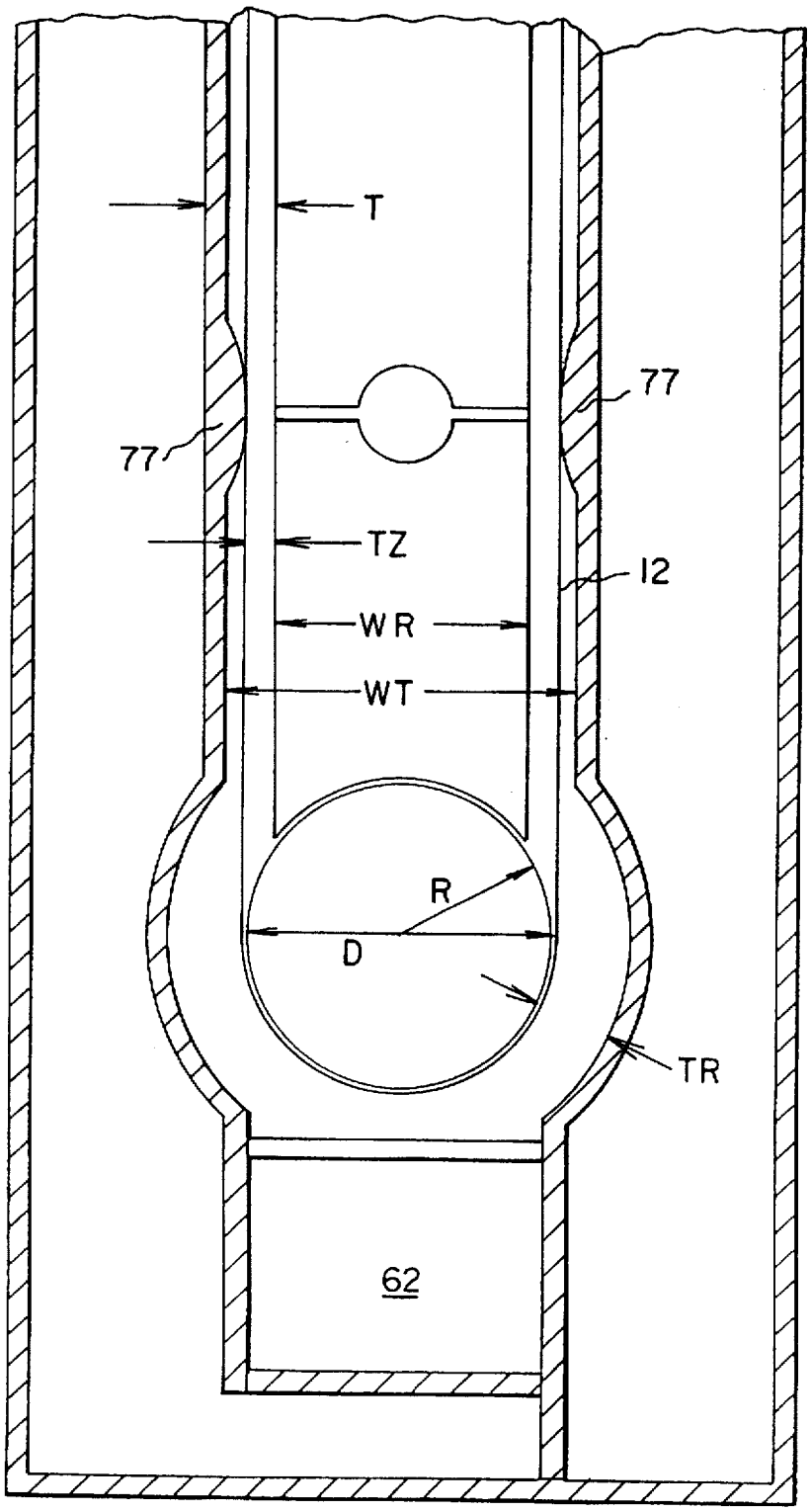
FIG. 7 is a view similar to FIG. 6 illustrating a modified form of the present invention.

In the embodiment illustrated in FIG. 6, the nozzles 76 are extended into the channel 44. However, the present invention is not limited to such. Referring to FIG. 7, there is illustrated a modified form of the present invention. In this embodiment the localized area 77 of the inner wall 38 directly opposite the nozzles are extended into the channel 44 thereby providing the same affect as when the nozzles were extended into the channel 44. The localized areas project into the channel 44 in accordance with the same relationships as did the nozzles 76 extend into channel 44 as previously discussed. That is TZ being less than about 5.5 mm, preferably less than about 3 mm.

Alternatively, both the nozzle and the localized area 77 may extend into the channel 44 to define the distance TZ.

It is to be understood that the distance TZ may vary in accordance with the impingement force of the processing solution leaving the nozzles 76. The providing of means for restricting movement of the photosensitive material with respect to the nozzle assures that the minimal amount of impingement force is directed against the photosensitive material even when a processing channel is provided which is larger than what would normally provide the degree of impingement required for efficient action. Preferably, the solution impinges against the photosensitive material so as to substantially remove the boundary layer.

Figure 3:
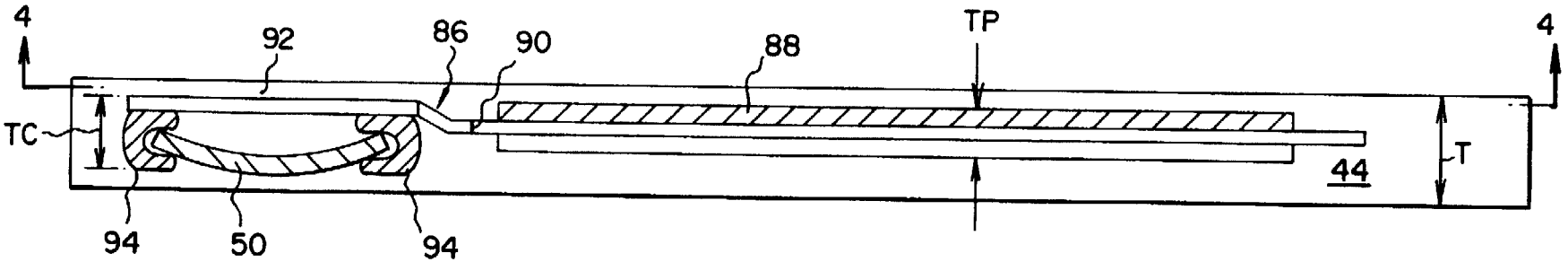
FIG. 3 is a cross-sectional view of the apparatus of FIG. 2 as taken along line 3—3 of FIG. 2.
Figure 4:
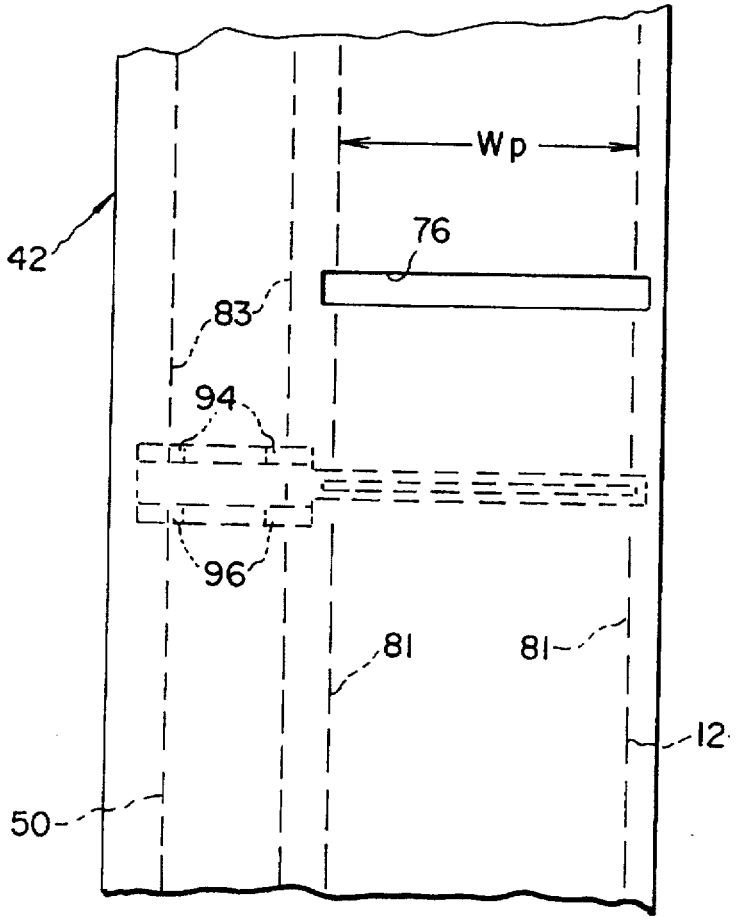
FIG. 4 is a partial elevational view of the rack of FIG. 3 as taken along line 4—4.
Figure 5:
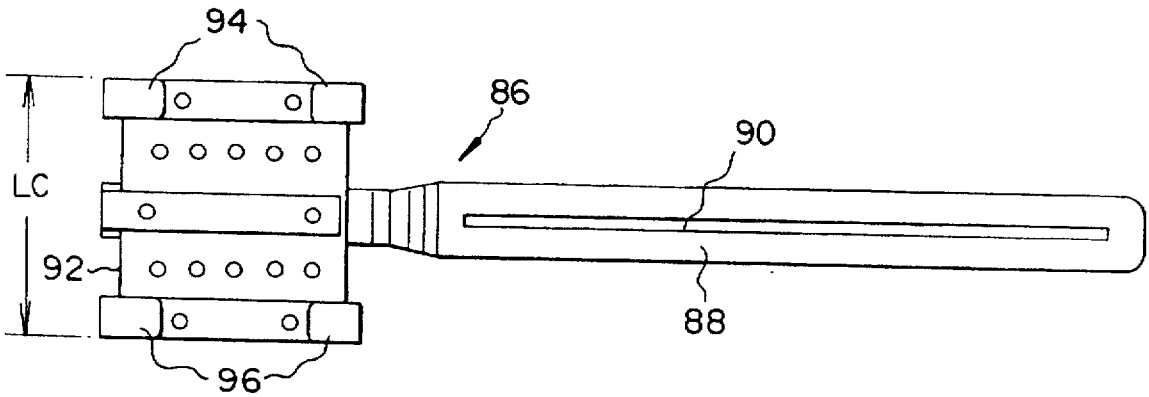
FIG. 5 is an enlarged plan view of the clip of FIG. 3.

Referring to FIG. 4, there is illustrated a partial elevational view of rack 42, as taken along line 4—4 of FIG. 3. Dash lines 81 indicate the lateral edges of the photosensitive material 12 as it passes through channel 44. The width of the photosensitive material 12 is indicated by WP. Dash lines 83 illustrate the position of the lateral edges of the belt 50 within channel 44.

Referring to FIG. 3, there is illustrated a cross-sectional view of the processing channel 44 taken along line 3—3 of FIG. 2. As previously discussed, clip 86 is provided for transporting of the photosensitive material 12 through the processor 10. Referring to FIG. 3, clip 86 includes an attachment section 88 for attaching to the end of the photosensitive material 12. Typically, the attachment section 88 includes an elongated slot 90 through which the end of the photosensitive material 12 passes and is wrapped thereabout. The clip 86 also includes a mounting section 92 for attachment to belt 50, which is appropriately driven in a continuous loop through the processor. In the particular embodiment illustrated, the mounting section 92 includes two pair of spaced C-clip members 94,96 which slightly deform the belt 50 and thereby provide a sufficient amount of tension for securing of the clip 86 to belt 50. Thus, as the belt 50 moves, the clip 86 will also move, thereby transporting the photosensitive material 12 through the processor 10. It is, of course, understood that various other design configurations for the clips may be provided as appropriate for the processor.

Figure 8:
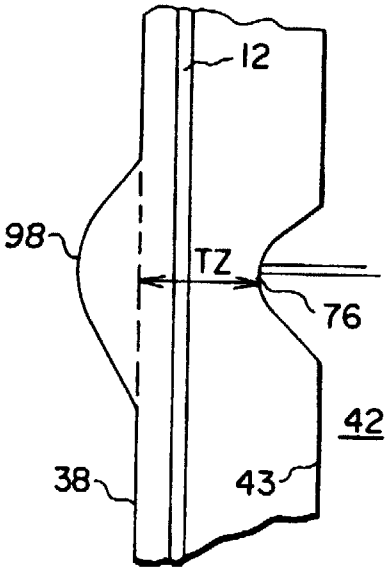
FIG. 8 is an enlarged cross-sectional partial view the processing channel adjacent the nozzle illustrating a modified form of the present invention.

As can be seen in FIG. 3, the processing channel 42 has a thickness T which is designed to be of sufficient width to allow the clip 86 and photosensitive material 12 to pass therethrough, but not too thick as to contain large amounts of processing solution. Referring to FIG. 8 there is illustrated an enlarged cross-sectional view of the chamber wall 38 and rack 42 adjacent one of the nozzles 76. In order to assures free and easy passage of the clip 86 through the narrowed restricted area of the channel 44, a small recess area 98 may be provided across from the projecting nozzle 76. The size of the recess is such that it will allow the clip 86 to easily pass by the projecting nozzle 76 but not allow the photosensitive material, due to its inherent rigidity, to be forced into the recess area 98. The photosensitive material will be restrained by the surface 38 of the chamber 40. Thus the thickness of the channel is effectively TZ in this area.

In a typical rack and tank type processing system, there is a relatively high radius turn through which the belt 50 and photosensitive material must pass. As illustrated in FIGS. 2 and 6, the photosensitive material must pass around roller 48. In the particular embodiment illustrated, the roller 48 has a diameter D (equal to 2 R). The diameter D of roller 48 is less than the width WT of the chamber 40 and preferably greater than the width WR of the rack 42. This assists in keeping the emulsion side of the material 12 from contacting the exterior wall 43 of rack 42. Applicants have found that due to the construction of the clip 86, and going through a sharp radius turn, there exists the possibility that the clip 86 may scrap, damage, or even disengage the belt 50 as it goes around the roller 48. It is extremely important that the clip 86 not be dislodged or scrapped on the side of the processing tank. This can result in serious damage to the equipment and to the photosensitive material passing through, and thus require substantial amounts of time to repair should it become necessary to remove the clip, not to mention the damage to the customer's photosensitive material. In typical prior art processors where a rack is simply placed in a large tank of solution, if the clip were to disengage the belt, the clip would simply sink to the bottom and stay there until normal maintenance of the tank occurred. However, in a low volume thin processor having a narrow processing channel, it is not possible to wait to remove the clip. Therefore, to minimize the possibility of the clip hanging up, the lower portion of the processing channel in the area of the turn-around section 47 is made larger. Thus, the thickness of the processing channel in the turn-around section 47 is made such that the processing channel 44 has a thickness TR, which is greater than the thickness T of the processing straight sections 45,49 of the processing channel 44. The thickness TR will vary in accordance with the size of the radius R and the size of the clip 86. In the particular embodiment, the clip 86 has a thickness TC in the mounting section 92. TC is the largest thickness of the clip 86 and, therefore, is the most critical part that must be taken into account when determining the thickness TR of the turn-around section 47. It is also important to take into account the length LC of the clip 86, as this will also have an affect on the thickness TR required for the clip 86 to properly turn around radius R. Due to these large number of variables, the thickness TR can be determined once the thickness TC, the length LC, and the radius of curvature R of the roller are known. In the particular embodiment illustrated, the roller 48 has a radius R of about 42 mm, and the clip 86 has a thickness TC of about 10 mm and a length LC of about 40.0 mm. Applicants have found that when using a clip 86 having this size relationship, that the thickness TR should be in the range of about 6.5 mm to 30 mm, preferably from about 6.5 mm to 16.0 mm. It can be seen that the thickness TR will need to be greater than the thickness T, and in most situations where it is desirable to minimize the thickness T of the processing channel 44.

In the embodiment illustrated, the clip members 94,96 are connected by a flexible support member 95 which assist in conforming the mounting section 92 to radius of the roller 47. A more detailed description of clip 86 is found in co-pending U.K. Patent Application No. 970030340; filed Feb. 14 , 1997; entitled "A Clip" (Attorney Docket No. 75329), which is hereby incorporated herein in its entirety.

The processing station 18 is of the low volume thin tank type construction. That is, a relatively small amount of processing solution is allowed in the processing channel 44 and the recirculation system 32. This is accomplished by providing a relatively narrow processing channel and by minimizing the amount of processing solution passing through the recirculation system. For the purposes of the present invention, a low volume thin tank processor is a processor wherein the ratio of the total volume of processing solution (i.e., processing solution within the processing channel and recirculation system) to the maximum area of the photosensitive material that can be accommodated within the processing channel is less than 35 $dm^3/mm^2$. Preferably, this ratio is less than 11 $dm^3/mm^2$, and most preferably, less than about 3 $dm^3/mm^2$. The total volume of the processing solution within the processing channel 44 is preferably such that the volume of the processing solution in the processing channel comprises at least 40% out of the total processing solution available in the processing channel 44 and recirculation system 32. Preferably, this ratio it at least 50%.

Examples of low volume thin tank processing systems are described and disclosed in the following patent specifications: U.S. Pat. Nos. 5,294,956; 5,179,404; and 5,270,762; EP 559 025; EP 559026; EP 559 027; WO92/10790; WO92/17819; WO93/04404; WO92/17370; WO91/19226; WO91/12567; WO92/07302; WO93/00612; and WO92/07301.

Thus, it can be seen that there is provided an apparatus wherein a low volume thin tank processor is provided, yet appropriate accommodations are made for allowing the clip to easily pass through the processing channel without any substantial reduction of the impingement of the processing solution against the photosensitive material.

It is to be understood that various other changes and modifications may be made without departing from the scope of the present invention, the present invention being limited by the following claims.

| Parts List: | |
|---|---|
| 10 | apparatus |
| 12 | photosensitive material |
| 14 | supply roll |
| 16 | supply chamber |
| 18,20,22,24 | processing stations |

-continued

| Parts List: | |
|---|---|
| 26 | dryer section |
| 28 | take-up roller |
| 29 | exit |
| 30 | narrow processing channel |
| 32 | recirculation systems |
| 34 | processing tank |
| 36 | exterior wall |
| 38 | inner wall |
| 40 | chamber |
| 42 | rack |
| 43 | exterior wall |
| 44 | narrow processing channel |
| 45 | first straight section |
| 47 | turn-around section |
| 48 | turn-around roller |
| 49 | second straight section |
| 50 | continuous belt |
| 52,54 | guide rollers |
| 56 | entrance |
| 58 | exit |
| 60 | photographic processing solution |
| 62 | outlet |
| 64 | conduit |
| 66 | recirculation pump |
| 68 | conduit |
| 70 | filter assembly |
| 72 | conduit |
| 74 | inlet |
| 76 | slot nozzles |
| 77 | localized area |
| 81,83 | dash lines |
| 86 | clip |
| 88 | attachment section |
| 90 | elongated slot |
| 92 | mounting section |
| 94,96 | C-clip, member |
| 95 | flexible support member |

I claim:

1. A photographic processor for processing a photosensitive material, comprising:

at least one processing channel for containing a processing solution through which the photosensitive material passes for processing, said channel having a substantially constant thickness T, at least one slot nozzle is provided for directing processing solution against the photosensitive material passing through said processing channel, said channel being shaped such that the nozzle is disposed a distance less than T from the opposing side wall of the channel such that the processing solution impinges against the photosensitive material;

wherein the nozzle is spaced from the opposing wall of the channel a distance TZ not greater than 5.5 mm.

2. A processor according to claim 1 wherein the distance TZ is no greater than about 3.0 mm.

3. A processor according to claim 1 wherein said nozzle extends outward from the wall in which it is disposed.

4. A processor according to claim 3 wherein a recessed area is provided opposite said nozzle.

5. A photographic processor for processing a photosensitive material, comprising:

at least one processing channel for containing a processing solution through which the photosensitive material passes for processing, said channel having a substantially constant thickness T, at least one slot nozzle is provided for directing processing solution against the photosensitive material passing through said processing channel, said channel being shaped such that the nozzle is disposed a distance less than T from the opposing side wall of the channel such that the processing solution impinges against the photosensitive material;

wherein the area of the wall opposite said nozzle extends into the processing channel.

6. A photographic processor for processing a photosensitive material, comprising:

at least one processing channel for containing a processing solution through which the photosensitive material passes for processing, said channel having a substantially constant thickness T, at least one slot nozzle is provided for directing processing solution against the photosensitive material passing through said processing channel, said channel being shaped such that the nozzle is disposed a distance less than T from the opposing side wall of the channel such that the processing solution impinges against the photosensitive material;

wherein both walls of the processing channel adjacent the nozzle extend to the processing channel.

7. A photographic processor for processing photosensitive material, comprising at least one processing section, said processing section comprising a tank which forms a generally U-shaped chamber and a rack for placement in said chamber and forming a narrow processing channel between said rack and said tank for containing the processing solution, at least one nozzle is provided in said rack for directing processing solution against the photographic material passing through said processing channel, said rack and chamber being shaped such that said channel adjacent said at least one nozzle is not greater than about 5.5 mm.

8. A photographic processor for processing photosensitive material, comprising at least one processing section, said processing section comprising a tank which forms a generally U-shaped chamber and a rack for placement in said chamber and forming a narrow processing channel having a thickness T between said rack and said tank for containing the processing solution, at least one nozzle is provided for directing processing solution against the photographic material passing through said processing channel, said nozzle being positioned such that it is disposed from the opposing wall of the channel a distance TZ no greater than 5.5 mm.

9. A processor according to claim 8 wherein both walls of the processing channel adjacent the nozzle extend to the processing channel.

10. A photographic processor for processing photosensitive material, said processor having a processing section having a narrow thin processing channel of substantially constant thickness T for containing a processing solution through which the photosensitive material passes for processing, a belt is provided for transporting of the photosensitive material through the processing channel, said processing channel in the area through which the photosensitive material passes having a thickness TZ less than said substantially constant thickness T such that the processing solution impinges against the photosensitive material.

11. A processor according to claim 10 wherein the nozzle is spaced from the opposing wall of the channel a distance TZ not greater than 5.5 mm.

12. A processor according to claim 10 wherein the distance TZ is no greater than about 3.0 mm.

13. A processor according to claim 10 wherein said nozzle extends outward from the wall it is disposed.

14. A processor according to claim 10 wherein the area of the wall opposite said nozzle extends into the processing channel.

15. A processor according to claim 11 wherein a recessed area is provided opposite said nozzle.

* * * * *